United States Patent [19]

Moskin et al.

[11] 4,425,488

[45] Jan. 10, 1984

[54] PISTOL GRIP CONTROLLER

[76] Inventors: Jeffrey M. Moskin, 1644 Twentieth St., Santa Monica, Calif. 90404; Keith J. Wertz, 2533 S. Deegan Dr., Santa Ana, Calif. 92704

[21] Appl. No.: 384,898

[22] Filed: Jun. 4, 1982

[51] Int. Cl.[3] ..... H01H 29/20

[52] U.S. Cl. ..... 200/220; 200/6 A; 200/61.52; 200/61.47; 200/153 A

[58] Field of Search ..... 200/157, 187, 153 K, 200/220, 277, 6 A, 61.45 R, 61.47, 61.52, DIG. 29, 153 A

[56] References Cited

U.S. PATENT DOCUMENTS

| | | | |
|---|---|---|---|
| 1,107,245 | 8/1914 | Bard | 200/153 A |
| 1,414,932 | 5/1922 | Chisman | 200/153 A |
| 1,609,191 | 11/1926 | Podell | 338/151 |
| 2,303,360 | 12/1942 | Irwin et al. | 200/61.52 R X |
| 2,390,846 | 11/1945 | Obszarny | 200/157 |
| 2,956,633 | 10/1960 | Noland, Jr. | 200/52 R X |
| 3,018,750 | 1/1962 | Hill | 200/157 |
| 3,161,738 | 12/1964 | Hall | 200/61.52 |
| 3,235,685 | 2/1966 | Litteral | 200/61.52 |
| 3,701,093 | 10/1972 | Pick | 340/52 H |
| 3,733,447 | 5/1973 | Schneider, Jr. | 200/61.52 |
| 3,752,945 | 8/1973 | Achterberg | 200/277 |
| 3,876,850 | 4/1975 | Amberny | 200/220 |
| 4,099,040 | 7/1978 | Bitko | 200/220 |
| 4,107,642 | 8/1978 | Crummett | 338/128 |
| 4,124,787 | 11/1978 | Aamoth et al. | 200/153 K |
| 4,246,452 | 1/1981 | Chandler | 200/5 A |
| 4,278,854 | 7/1981 | Krause | 200/52 A |
| 4,279,683 | 10/1981 | Roberts | 156/397 |
| 4,318,245 | 3/1982 | Stowell et al. | 46/232 |

FOREIGN PATENT DOCUMENTS

| | | | |
|---|---|---|---|
| 378104 | 9/1907 | France | 200/153 A |
| 2428316 | 2/1980 | France | 200/220 |
| 209048 | 4/1966 | Sweden | 200/61.45 R |

*Primary Examiner*—John W. Shepperd
*Assistant Examiner*—Renee S. Kidorf
*Attorney, Agent, or Firm*—Roberts and Quiogue

[57] ABSTRACT

A pistol grip controller having a miniature multi-position tilt switch contained within the grip handle is disclosed. The tilt switch includes separate circuit contacts disposed about the inside of a switch housing and also includes a common contact that includes one or more commonly connected contact elements. A movable contact element completes the circuit connection between one of the separate contacts and the common contact in response to the movement imparted to the switch. The movable conductive element can be a conductively plated ball, a sliding conductive element, or a conductive fluid such as mercury. The pistol grip handle further indicates an index finger actuated switch and a thumb actuated switch. The pistol grip handle is removable mounted on a resilient mounting post that is secured to a base.

9 Claims, 9 Drawing Figures

PISTOL GRIP CONTROLLER

BACKGROUND OF THE INVENTION

1. Field of the Invention

This invention is directed to a pistol grip controller that is responsive to X-Y movements and is particularly directed to a pistol grip controller utilized for the manipulation of images on a video display.

2. Description of the Prior Art

Prior art hand controllers included joysticks which utilized microswitches to produce switching action in response to X-Y movements.

Another prior art hand controller is found in U.S. Pat. No. 4,124,787 issued to Aamoth et al on Nov. 7, 1978. That patent discloses a joystick controller that includes a plurality of pressure actuated switches disposed about the axis of the joystick handle. Movement of the joystick handle causes the displacement of appropriate operating arms adjacent the switches.

The prior art hand controllers such as joysticks are complex, unreliable, expensive to manufacture, and subject to failure from rough handling. Moreover, the prior art joystick controllers require a base for containing the switching elements, in addition to the controller handle. Generally, that base also includes a thumb-actuated switch which may be positioned to favor right hand control of the joystick cumbersome for left-handed persons.

SUMMARY OF THE INVENTION

It is therefore an object of the invention to provide a pistol grip controller.

It is further an object of the invention to provide a pistol grip controller that is inexpensive and reliable.

Yet another object of the present invention is to provide a pistol grip controller that is economical to manufacture.

A further object of the invention is to provide a pistol grip controller that does not require a base to contain the switching elements.

Still another object of the invention is to provide a pistol grip controller that is equally convenient for left or right handed use.

The foregoing and other objects of the invention are accomplished in a pistol grip controller having a formed pistol grip handle that encloses a miniature multi-position tilt switch that includes separate stationary contacts disposed about the inside perimeter of the switch housing. The bottom of the switch housing includes a common contact. A movable conductive element, such as a conductively plated ball, is contained within the switch housing and completes the circuit between one of the perimeter contacts and the housing bottom common contact when the switch is tilted. When the switch is in the neutral horizontal position, the movable contact does not touch any of the perimeter contacts. A thumb actuated switch and a forefinger actuated switch are built into the formed pistol grip handle.

In another embodiment, the multi-position tilt switch enclosed in the pistol grip handle or lever includes a plurality of contact pairs disposed about the inside perimeter of the switch housing wherein each contact pair includes a separate contact and a common contact. A conductive fluid is contained in the switch housing which causes a separate contact to be conductively coupled with its common contact when the switch is tilted from horizontal.

In a further embodiment, the multi-position tilt switch enclosed in the pistol grip handle includes a plurality of separate contacts disposed about the inner perimeter of the switch housing and a centrally disposed common contact. The movable contact element is a conductive fluid which conductively couples one of said separate contacts with said common contact when the switch is tilted.

BRIEF DESCRIPTION OF THE DRAWING

The advantages and features of the invention will be readily apparent to persons skilled in the art from the following detailed description when read in conjunction with the drawings herein.

DETAILED DESCRIPTION OF THE INVENTION

Figure 1:
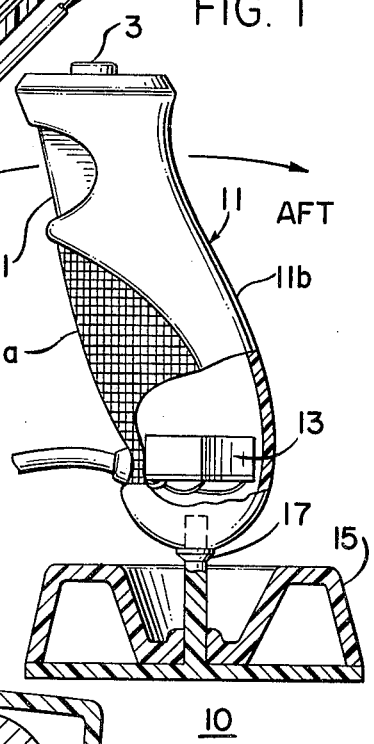
FIG. 1 is a partial cut-away view of the pistol grip controller of the invention.

Referring to FIG. 1, shown therein is the pistol grip controller 10 of the invention that includes a formed pistol grip handle 11. The grip handle 11 is formed to rest comfortably in a player's hand, lessening fatigue and enhancing game playing. The grip handle 11 includes a knurled or textured finger grip portion 11*a* that is suitable for enclosure by a player's third through fifth fingers. The grip handle 11 further includes a palm grip portion 11*b* that is suitable for enclosure by a player's palm.

An index finger actuated squeeze trigger switch 1 is built into the top forward portion of the grip handle 11, and a thumb actuated switch 3 is built into the top of the grip handle 11. The switches 1 and 3 can be connected in parallel, so that actuating either switch activates the same element or aspect of a video game; or the switches 1 and 3 can be independently wired so that each switch can activate different elements of a video game. The advantages of the locations of the switches 1 and 3 include the comfortable use of the pistol grip controller 10 by both right-handed and left-handed persons.

The grip handle 11 is mounted on a base 15 that includes a mounting post 17 for the grip handle 11. The mounting post 17 can be a solid resilient plastic prong or a coil spring; or the mounting post can be solid resilient plastic prong surrounded by a coil spring. The mounting post 17 provides an interference fit with the grip handle 11, thereby preventing rotation of the grip handle about the axis of the mounting post 17.

The base 15 is intended to rest on a horizontal surface such as a table. The grip handle 11 is shaped so that it has a comfortable predetermined forward angle in the imaginary firing direction relative to the vertical in the neutral position when the mounting post 17 is not biased. The fore and aft directions of movement of the grip handle are shown on FIG. 1. The predetermined forward angle of the grip handle 11 should be in accordance with standard well known ergonomic data, thus providing for a comfortable "feel" in the neutral position and further providing an accurate "feel" for the orientation of the grip handle 11. The predetermined forward angle renders it easier to point with the hand in firing position. Incidentally, having the grip handle 11 at a predetermined angle is analogous to the orientation of grips in pistol handguns.

Enclosed within the grip handle 11 is a miniature multi-position tilt switch 13 which produces switch closures in response to tilting movement of the grip handle 11. The multiposition tilt switch 13 is mounted to be in a neutral horizontal position when the grip handle is in the neutral position.

The pistol grip handle 11 can be removed from the base 15 and remains fully functional insofar as the switch 13 is contained in it.

Figure 2:
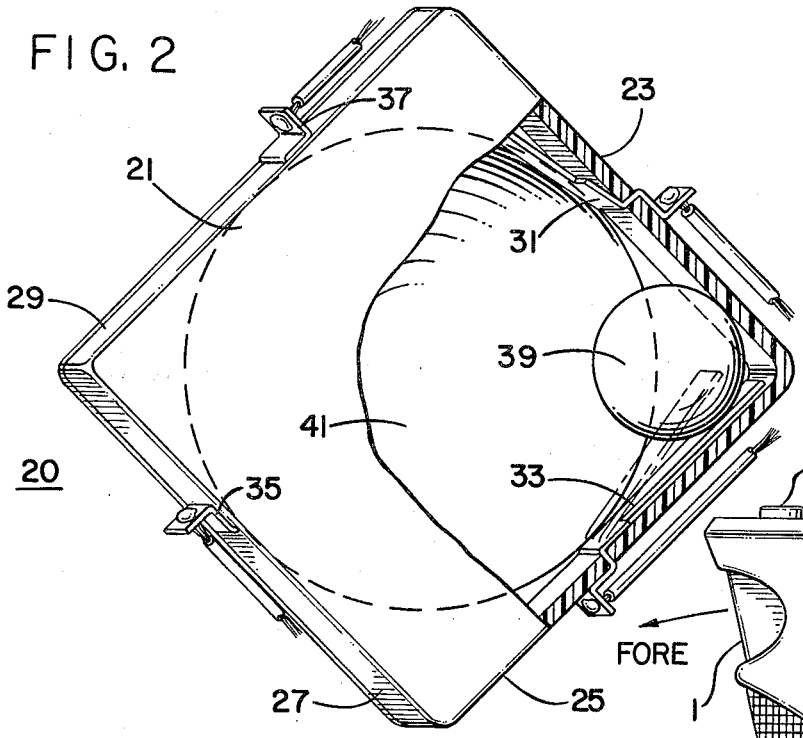
FIG. 2 is a top view of a multi-position tilt switch with a conductively plated ball contact that can be used in the pistol grip controller of FIG. 1.
Figure 3:
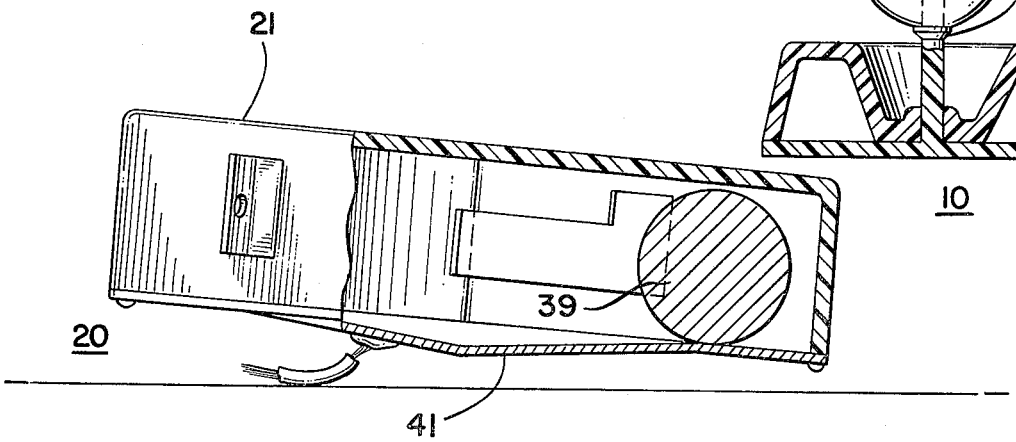
FIG. 3 is a side view of the switch of FIG. 2.

Referring now to FIGS. 2 and 3, shown therein are top and side views, respectively, of a multi-position tilt switch 20 that can be used as the switch 13 in the pistol grip controller 10 of FIG. 1. The tilt switch 20 includes a nonconductive housing that includes a top 21 and sides 23, 25, 27 and 29. The housing sides 23, 25, 27 and 29 are shown as forming a square. However, the sides for the switch 20 can be readily made to form a polygon or a regular polygon having more sides such as an octagon. Mounted in each of the sides 23 through 29 are spring contacts 31, 33, 35 and 37. The lever portions of the spring contacts are disposed within the housing of the switch 20 so that they can be individually contacted by a conductive ball 39.

A concave housing bottom or floor 41 forms the bottom part of the housing for the switch 20 and is a conductive plate that forms a common contact. The conductive floor plate 41 is concave so that when the switch is in a horizontal position, the conductive ball 39 will rest in the center of the bottom plate 41. When the switch 20 is appropriately tilted towards one of the corners (as illustrated) the conductive ball 39 will bias one of the spring contacts, thereby completing the circuit between the common contact formed by the conductive plate 41 and one of the individual contacts.

In the switch 20 of FIGS. 2 and 3, the spring contacts 31 through 37 can comprise of brass contacts that are nickel plated. The spring contacts absorb the kinetic energy of the conductive ball 39 and thereby prevent contact bounce. The conductive housing bottom plate 41 can be made of brass or some other conductive material, or it can be a nonconductive base with a conductive surface, such as a printed circuit board.

Figure 4:
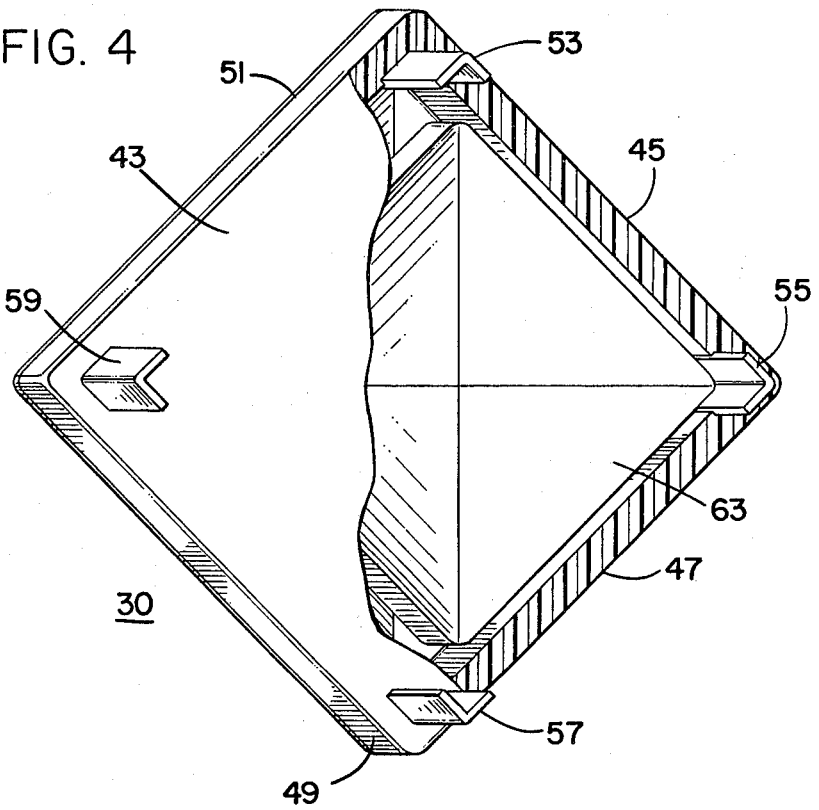
FIG. 4 is a top view of a multi-position tilt switch with a sliding contact that can be used in the pistol grip controller of FIG. 1.
Figure 5:
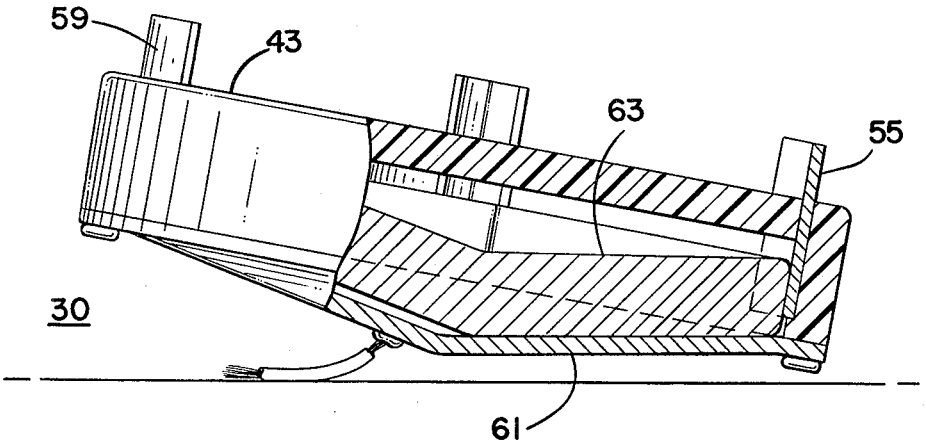
FIG. 5 is a side view of the switch of FIG. 4.

Referring now to FIGS. 4 and 5, shown therein are top and side views, respectively, of another multi-position tilt switch 30 that can be used as the tilt switch 13 in the pistol grip controller 10 of FIG. 1. It includes a nonconductive housing top 43 and sides 45, 49 and 51. Although the sides of the switch 30 form a square, other polygons and regular polygons may be used as discussed relative to the tilt switch 20 of FIGS. 2 and 3.

Fitted in the proximity of the corners or apexes formed by the switch housing sides 45 through 51 are individual contacts 53, 55, 57, and 59. A housing bottom or floor 61 of the switch 30 is a conductive plate and further forms a common contact. The housing bottom 61 is formed as an inverted pyramid which can be achieved with a metal stamping such as brass and is coupled to the housing sides 45 through 51. Of course, the bottom housing 61 can comprise a nonconductive base that is properly formed and has a conductive surface.

The inverted pyramidally shaped switch housing floor plate 61 has a centrally disposed apex. The intersections of the inner triangular faces of the floor plate 61 extend outwardly to the respective apexes formed by the housing sides 45 through 51.

Located within the switch is an inverted pyramidally shaped movable conductive element 63 that is adapted to fit the pyramidal shape of the conductive floor 61. The sides of the conductive element 63 are smaller in dimension than the conductive housing sides of the switch 30. The downward triangular faces of the movable element 63 correspond to respective upward triangular faces of the floor plate 61.

Where the sides of the switch 30 form a polygon, such as an octogon, the bases of the inverted pyramid floor 61 is the same polygon and is formed by the intersection of the floor and the sides. The inverted pyramidal movable conductive element 63 would then have a similar and smaller polygon for a base.

The inclination of the inside surfaces of the conductive housing bottom 61 is preferably steeper than the inclination of the inner surface of the conductive housing bottom 41 of the switch 20. The steeper inclination is necessitated by the increased friction due to the sliding action of the contact element.

The intersections of the inner triangles of the bottom floor plate 61 form races in which the movable conductive element 63 can readily slide. However, movement of the movable conductive element is not limited to such intersections.

Figure 6:
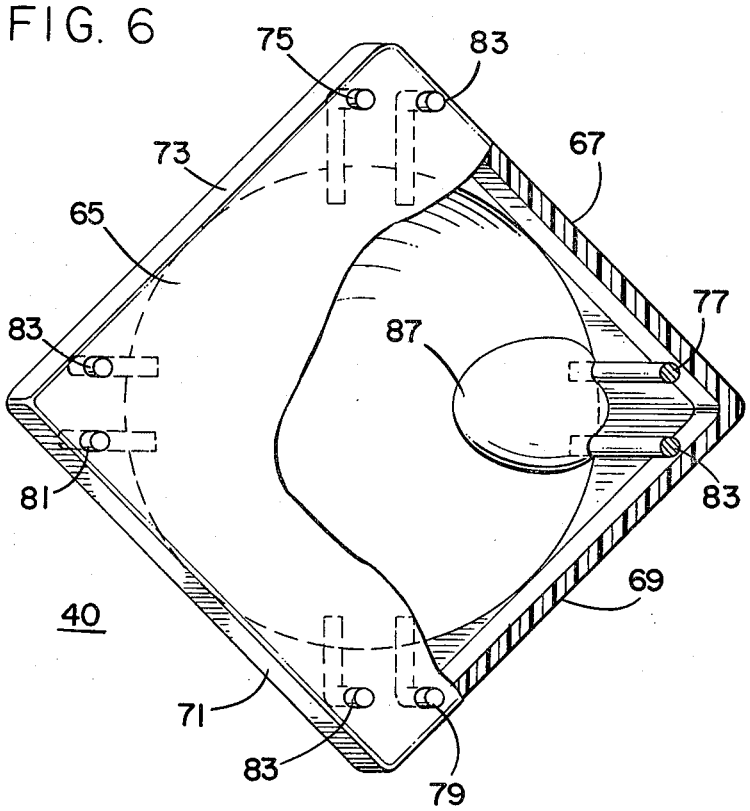
FIG. 6 is a top view of a multi-position tilt switch with conductive fluid as a switch closing element that can be used in the pistol grip controller of FIG. 1.
Figure 7:
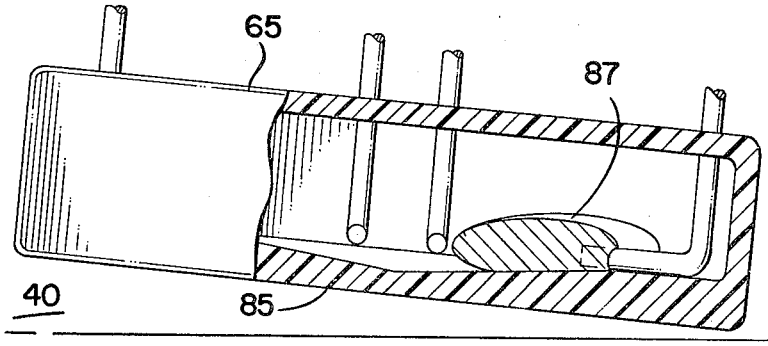
FIG. 7 is a side view of the switch of FIG. 6.

FIGS. 6 and 7 show the top and side views, respectively, of another multi-position tilt switch 40 that can be used as the tilt switch 13 in the pistol grip controller 10 of FIG. 1. It includes a nonconductive switch housing having a top 65 and sides 67, 69, 71 and 73. Although the sides form a square, another polygon or a regular polygon can be utilized as discussed relative to the switches 20 and 30. At each of the corners or apexes formed by the sides of the switch housing are respective pairs of contacts. Each pair includes respective separate contacts 75, 77, 79 and 81. Associated with each of the separate contacts is a common contact 83 which are commonly connected (not shown).

The switch 40 further includes a nonconductive housing bottom or floor 85 which has a concave inner surface. Mercury or some other conductive fluid 87 is contained within the housing of th switch 40. When the switch is in the horizontal position, the conductive fluid 87 remains in the center portion of the housing bottom 85. In that circumstance none of the circuits between the common contact 83 and the separate contacts 75 through 81 are complete. When the switch housing is tilted so that the conductive fluid comes into contact with one of the separate contacts 75 through 81 and its associated common contact 83, a switching circuit is completed.

Figure 8:
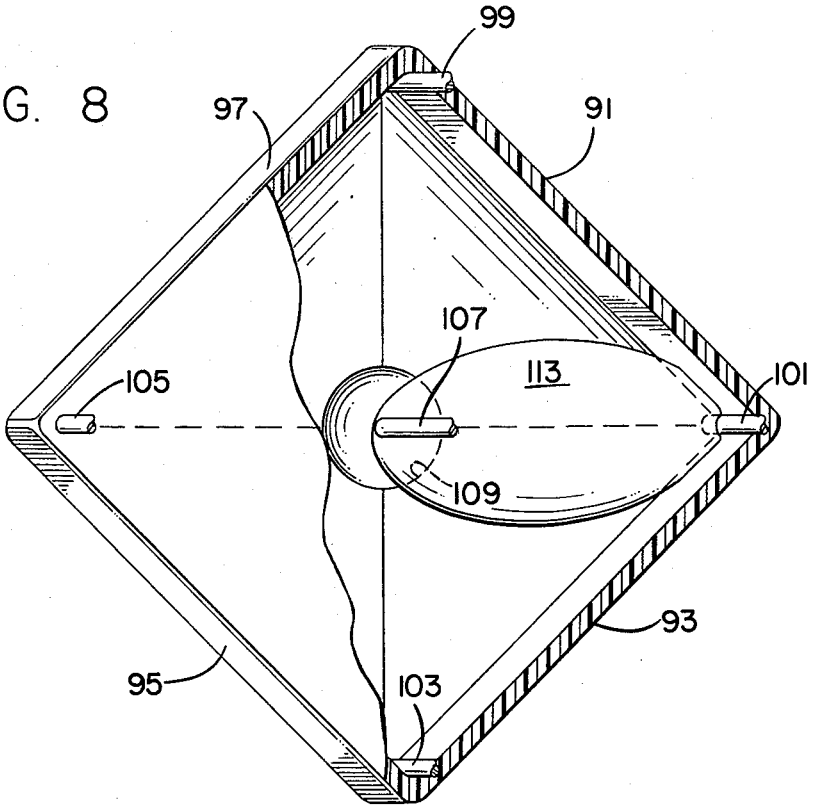
FIG. 8 is a top view of another multi-position tilt switch with conductive fluid that can be used in the pistol grip controller of FIG. 1.
Figure 9:
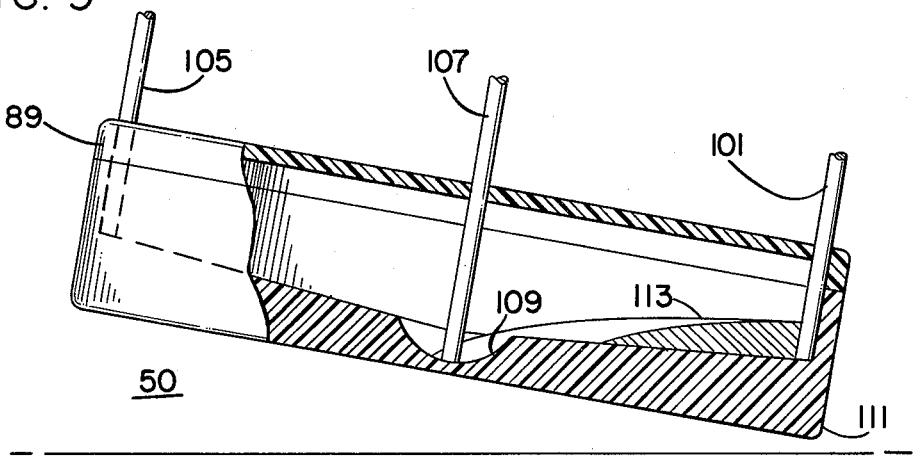
FIG. 9 is a side view of the switch of FIG. 8.

FIGS. 8 and 9 show respective top and side views of another miniature multi-position tilt switch 50 having conductive fluid and which can be used on the tilt switch 13 in the pistol grip controller 10 of FIG. 1. It includes a nonconductive switch housing having a top 89 and sides 91, 93, 95 and 97. These sides, as shown, form a square, but another polygon or regular polygon can be used as discussed relative to the switches 20, 30 and 40.

At each of the corners or apexes formed by the sides 91 through 97 are separate contact wires 99, 101, 103 and 105 which are secured in the housing top 89. A common contact 107 is centrally secured in the housing top 89 and extends into a centrally-disposed partially spherical reservoir cavity 109 in a housing bottom or floor 111. The inside of the floor 111 is shaped similarly to the floor 61 of the switch 30, in that the floor 111 includes part of the triangular faces of an inverted pyramid. However, the side walls are truncated prior to the imaginary apex to form the perimeter of the partially spherical reservoir cavity 109.

A conductive fluid 113 such as mercury forms a movable contact element to conductively couple at least one of the separate contacts 99 through 105 with the common contact 107. When a plurality of separate contacts are conductively coupled to the common contact 113, the closing of the plurality of contact circuits can be appropriately decoded or processed to indicate direction of tilt. The reservoir cavity 109 allows for faster return of the conductive fluid 113 to the center portion of the switch floor 111 when the switch 50 is returned to horizontal.

Evidently, the bottom or floor 85 of the switch 40 of FIGS. 6 and 7 can also be shaped like the floor 111 of the switch 50 to include part of pyramid faces and a centrally disposed partially spherical cavity.

One of the foregoing multi-position tilt switches 20, 30, 40 and 50 is placed within the pistol grip handle 11 with one of the apexes formed by the switch housing sides toward the forward direction of the grip handle. Thus, relative to a switch that has a floor or bottom with triangular faces or sections of triangular faces, the intersection line of the bottom faces which leads to the forward apex is in the same plane as the angle formed by the forward lean of the grip handle 11 relative to vertical. As discussed previously the tilt switch 13 in the grip handle 11 is in the neutral horizontal position when the grip handle 11 is in the neutral position at a predetermined forward lean angle.

In the foregoing multi-position tilt switches for the hand controller 10 of FIG. 1, the switching closures are achieved by closing the circuit path between one of the separate contacts and the common contact. By utilizing an octagonal shaped switch housing and eight separate contacts with a common contact, an eight-pole tilt switch can be achieved.

Although the foregoing has been directed to particular embodiments of the invention, changes and modifications thereto can be made by persons skilled in the art without departing from the spirit and scope of the invention as defined by the following claims.

What is claimed:

1. A pistol grip controller comprising:

a pistol grip handle;

a tilt switch housing enclosed within said pistol grip handle having sides forming a polygon and a bottom shaped as an inverted pyramid merging upwardly to said sides;

respective separate contacts disposed in the proximity of each of the apexes formed by said sides;

a common contact; and a movable conductive means for conductively coupling said common contact with one or more of said separate contacts in response to tilting of the pistol grip handle.

2. The pistol grip controller of claim 1 wherein said movable conductive means comprises a conductive fluid.

3. The pistol grip controller of claim 2 wherein said conductive fluid comprises mercury.

4. A pistol grip controller comprising:

a pistol grip handle;

a plurality of player activated switches on the outside of said pistol grip handle;

tilt switch means contained in said handle responsive to the tilting of said handle, and including a non-conductive switch housing having a pyramidally shaped bottom and a centrally disposed cavity in said bottom;

a plurality of separate circuit contacts disposed about said housing;

a common contact extending into said cavity; and movable conductive means for conductively coupling one or more said separate circuit contacts with said common contact in response to tilting of said pistol grip handle.

5. The pistol grip controller of claim 4 wherein said separate contacts comprise wire contacts.

6. The pistol grip controller of claim 4 wherein said movable conductive means comprises a conductive fluid.

7. The pistol grip controller of claim 6 wherein said conductive fluid comprises mercury.

8. A pistol grip controller comprising:

a pistol grip handle;

a tilt switch housing enclosed within said pistol grip handle having sides forming a polygon and a bottom shaped as an inverted pyramid merging upwardly to said sides, and further including a centrally disposed reservoir cavity;

respective separate contacts disposed in the proximity of each of the apexes formed by said sides;

a centrally disposed common contact extending into said reservoir cavity; and movable conductive means comprising a conductive fluid for conductively coupling said common contact with one or more of said separate contacts in response to tilting of the pistol grip handle.

9. The pistol grip controller of claim 8 wherein said conductive fluid comprises mercury.

* * * * *